United States Patent [19]

Fischer

[11] 4,143,959

[45] Mar. 13, 1979

[54] COMPACT X-RAY FILM PROCESSOR

[76] Inventor: Warren G. Fischer, 4N003 Wildrose Rd., St. Charles, Ill. 60174

[21] Appl. No.: 747,342

[22] Filed: Dec. 3, 1976

[51] Int. Cl.[2] ..... G03D 3/08

[52] U.S. Cl. ..... 354/316; 354/322

[58] Field of Search ..... 354/307, 316, 319, 320, 354/321, 322, 89, 90, 91, 92, 93, 310, 312, 313, 314; 134/64 P, 122 P

[56] References Cited

U.S. PATENT DOCUMENTS

| | | | |
|---|---|---|---|
| 3,195,438 | 7/1965 | Woodcock | 354/321 |
| 3,383,996 | 5/1968 | Dokulil et al. | 354/299 |
| 3,532,048 | 10/1970 | Hope | 354/320 |
| 3,610,130 | 10/1971 | Langkopf | 354/322 |
| 3,873,988 | 3/1975 | Pfeifer et al. | 354/319 |
| 3,922,701 | 11/1975 | Geyken et al. | 354/319 |
| 4,086,607 | 4/1978 | Muller | 354/322 X |

*Primary Examiner*—L. T. Hix
*Assistant Examiner*—Alan Mathews
*Attorney, Agent, or Firm*—Eugene F. Friedman

[57] ABSTRACT

An X-ray film processor requiring access only on its top and on one side in order to both receive undeveloped film and deliver developed negatives. The processor takes in the film by moving it in a horizontal direction over the tanks of solution and the drying area. It then reverses the horizontal direction of the film to pass it through the usual solutions and drier. The film finds its way to a receptacle located below the processing portion of the apparatus and with an opening facing the same direction as the processor's inlet. The containers of solutions and the drier determine the space required for the processor.

8 Claims, 2 Drawing Figures

COMPACT X-RAY FILM PROCESSOR

BACKGROUND OF THE INVENTION

The development of exposed X-ray film generally proceeds through the use of one of two types of apparatus. The first continues the method exployed as long as X-rays themselves and simply places large containers of developing solutions in proximity to each other. A technician, in a darkened room, places the film sequentially in the correct tanks for, hopefully, the proper durations of time.

The problems inherent in this technique seem almost too obvious to need recounting. The technician requires substantial pay for his time and efforts, which could prove more fruitful on other tasks. Moreover, in a lightless room, he may unknowingly place the film in a wrong solution, ruining the exposure and requiring the reirradiation of the patient. Moreover, the resting time in each solution may not adhere to prescribed practices. Further, the temperatures of the solutions may vary from the preferred levels.

The second type of apparatus, automated processors, have ameliorated many of the above problems. Eliminating the need for a technician's constant attention, they, nonetheless, insure the proper dwell times in the correct solutions maintained at the desired temperature.

Notwithstanding the many clear advantages of the automated processors, many institutions continue the manual development of their X-ray films. The space required for the processors often appears as a major factor in a decision not to automate.

The automatic processors, in addition to room for the containers of fluids and drier, have an inlet on one side and an outlet on the other for the disgorgement of the film after its development. Further, the area on both sides of the processor must remain clear in order to allow access to the appropriate openings.

Not all institutions have sufficient space to accomodate a processor in a dark room. Some even go to the extreme of cutting through a wall to provide a slot for the developed films outside the dark room and minimize the space required on one side of the machine. Not all film handlers can or will take such a drastic step.

SUMMARY

Reversing the horizontal component of motion of the film during its passage through the processor eliminates the need for access to one side of the apparatus. Moreover feeding the film into the machine across its top and depositing the developed films into a receptacle below the solution containers and drier further compacts the processor.

Generally, a processor includes a number of containers holding film processing liquids. Most machines also possess a drier to remove the last liquid, usually water, and deliver dry negatives.

The processor also provides a motive device to move the films along a predetermined path. This usually takes the form of a motor with rollers, gears, and guides. An overall structure holds the parts together with the desired spatial relationship.

To reverse the film's lateral direction, the motive means must move the film in two directions at two different points along its path. These two directions must have horizontal components of motion differing from each other by 180°. Conveniently, the film may feed in along a shelf placed over the liquid containers and the drier. After entering the first liquid, the film then will generally move with a horizontal direction antiparallel to its initial motion that brought it into the machine.

A processor also generally includes a shield surrounding its innards. This blocks the passage of light and allows normal use in the room after the film's entry. The shield also typically defines the lateral limits of the processor. The motive device will considerably reduce the required space if it limits the motion of the film to, excepting a single direction, within a horizontal area defined by the lateral limits of the shield. The allowable exception, of course, represents the front of the machine and would, in any event, face the interior of the room. Allowing the film to move in this direction beyond the perimeter of the processor does not in reality add to the space required for it.

DETAILED DESCRIPTION

Figures 1, 2:
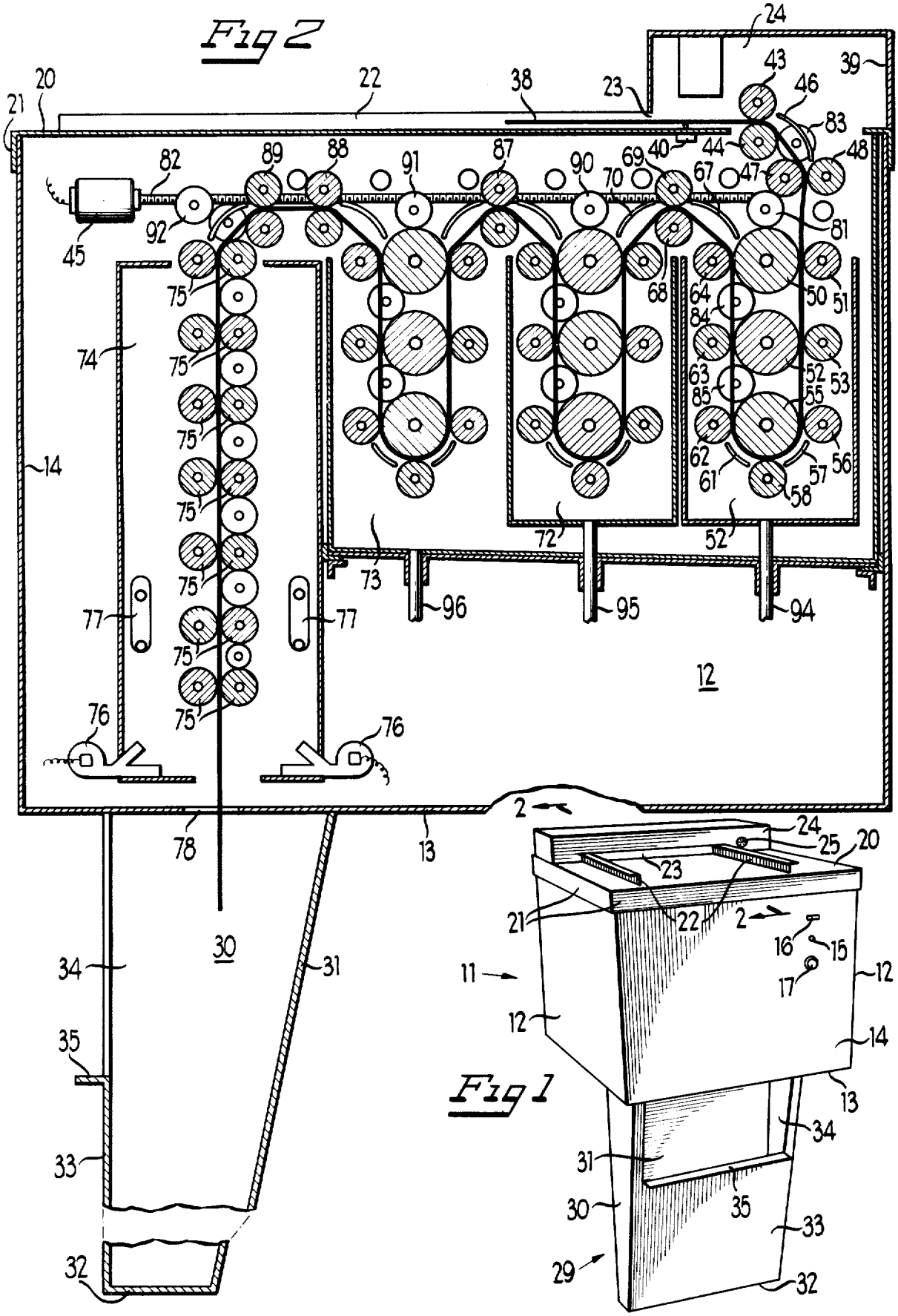
FIG. 1 shows, in a perspective view, a compact film processor requiring access to only its top and one side during operation.
FIG. 2 gives a cross sectional view, along the line 2—2, of the processor in FIG. 1, and depicts the reversal of the film's horizontal direction of motion.

FIG. 1 shows an X-ray film process generally at 11. The processor 11 includes the sides 12, the bottom 13, and the front 14. On the front 14 of the processor 11 appears the on-off switch 15, the signal light 16, and the fuse-holder 17. The light 16, when on, indicates both that the internal temperature and the position of any previously introduced piece of film permit the insertion of an X-ray film for processing.

The top 20 provides an upper cover for the processor 11 and includes the tightly fitting depending edge 21 to insure light tightness. The guides 22 direct film into the opening 23 in the projecting light barrier 24. The thermometer 25 gives the temperature of the developing solutions inside.

Attached to the bottom 13, the receptacle 29 catches developed dried negatives from the processor 11. The receptacle 29 has the sides 30, the back 31, and the bottom 32. The front 33 has the opening 34 to allow the manual retrieval of film in the receptacle 29. The lip 35 prevents damage to a person's hand when reaching for a film.

In FIG. 2, the heavy line 38 represents the path of the film through the processor 11. The film enters the processor through the opening 23 by moving toward the processor's rear 39. It passes over the microswitch 40, which, when the film has entered completely, signals the operator that he may turn on the room lights or feed in another film.

The rollers 43 and 44, receiving power ultimately from the motor 45, urge the film towards the processor's rear 39. The guide 46, however, deflects it downward to the rollers 47 and 48 which now positively urge the film toward the bottom 13. As it moves downwards, it encounters the rollers 50 and 51 in the tank 52. The tank 52 contains, typically, developer solution to begin the processing of the film.

The path 38 next passes down to the rollers 52 and 53 which also push the film down, as do the rollers 55 and 56. The guide 57 deflects the path to the front of the machine and the roller 58, in cooperation with the roller 55, positively move it in that direction.

At this point, the porcessor has accomplished the reversal in horizontal motive direction that results in the desired compactification. The film entering the opening 23 moves to the back 39 of the processor. As the film passes through the rollers 55 and 58, it travels to the processor's front 14.

The forward-travelling film next encounters the guide 61 which deflects it upward, in which direction the roller pairs 55 and 62, 52 and 63, and 64 and 50 keep it moving.

The guide 67 deflects the film horizontally to the rollers 68 and 69, which pass it along to the guide 70. The guide 70 deflects the film downward into the tank of the fixer solution 72, where it travels a path under similar controls as in the developer 52. From the fixer, the film goes to a water wash 73, to pass through which it again employs the same mechanical components as in the developer 52.

After the water bath 73, the film enters the drying area 74, through which it passes under the action of the roller pairs 75. While in the drier 74, the fans 76 blow dry air on it, while the heater controllers 77 maintain a salubrious evaporating temperature. When dry, the film drops through the opening 78 in the processors bottom 13 and into the receptacle 30.

The power for the movement of the film over the entire path 38 derives from the motor 45. Moreover, all of the rollers gear either directly together or indirectly through other gears to maintain the proper film speed throughout. For example, returning to the developer 52, the gear 81 possesses a direct mechanical linkage to the worm gear 82 which performs a similar function for the roller 48 and the further gear 83. This gear 83 rotates the roller 44 which has a linkage to the roller 43.

The gear 81 also turns the roller 50, which then performs a similar service on the rollers 51 and 64 as well as the gear 84. The gear 84 turns the roller 52 which then causes the rollers 53 and 63 and the gear 85 to rotate appropriately. The roller 55 receives its power from a geared relationship with the gear 85 and, in turn, rotates the rollers 56, 58, and 62.

The worm gear 82 also rotates the roller 69, which, geared to the roller 68, causes that to rotate too. The rollers 87, 88, and 89 and the gears 90, 91, and 92 also directly receive mechanical power from the worm gear 82 and, thus, provide motive power for all the gears and, ultimately, rollers in the fixer solution 72, the water bath 83, and the drier 74.

The rollers 51 and 61 have a spring loading against the larger roller 50 to accomodate the actual thickness of the X-ray film used. For the same reason, the rollers 53 and 63 can deposit a small distance from the larger roller 52 as can the rollers 56, 58, and 62 from the roller 55. A similar situation occurs in the fixer 72 and the water bath 73. Similarly, the rollers 43, 48, and 69 have a spring loading against their respective mates 44, 47, and 68, as do the rollers 87, 88, and 89.

The water in the water bath 73 serves a dual purpose. First, of course, it washes the developing and fixing solutions from the film when developed. The water, in addition to passing through the water bath 73, also circulates around the containers 52 and 72 of developer and fixer, respectively. Maintaining the water at the proper temperature, in this fashion, will also properly regulate the developer and fixer solutions. temperatures. The developer container 52 has the conduit 94. When opened, the conduit 94 allows the drawing of the developer solution from the container 52 with the expenditure of minimal effort. The conduit 95 performs a similar function for the fixer bath 72. Both of the conduits 94 and 95 pass through the water surrounding the containers 52 and 72 to avoid mixing it with the chemical solutions used. Lastly, the conduit 96 allows for the draining of the water itself.

Accordingly, what is claimed is:

1. In a film processor including:

(a) a plurality of containers for holding film processing fluids;

(b) drying means for removing liquids from processed films;

(c) motive means for moving and guiding a piece of film along a path passing through each of said plurality of containers and, subsequently, through said drying means, said motive means including a roller transport system with moving rollers, said rollers being the only moving components of said motive means contacted by said film;

(d) structural means coupled to said containers, said drying means, and said motive means, for maintaining a predetermined spatial relationship between said containers and said drying and said motive means;

(e) a receptacle coupled to said structural means and occupying a space below and substantially within the horizontal area of said containers and said drying means, said motive means, after moving a piece of film through said containers and said drying means, placing said piece of film in said receptacle and moving said piece of film no further; and (f) an enclosure with at least two of said containers located inside said enclosure, the improvement wherein (1) said motive means moves said film in a first direction at a first point on said path and in a second direction at a second point on said path, said first and second directions having respectively first and second horizontal components of motion differing by substantially 180°, (2) said enclosure has a first opening located therein near the top of said processor, said motive means initially moves film in said first direction along a first part of said path, with the beginning of said first part of said path being located near said first opening, the line of travel through said first opening in traveling from the inside to the outside of said enclosure being oriented in said second direction generally opposed to said first direction, said enclosure has a second opening along said path leading into said receptacle, said motive means deposits film into said receptacle along a second part of said path, said receptacle has a third opening therein, the line of travel through said third opening in traveling from the inside to the outside of said receptacle being said third direction generally parallel to said second direction and generally opposite to said first direction of said first part of said path and, (3) said processor has a side generally facing said second direction, whereby film may be fed into and removed from said processor with access only to said processor's top and said side.

2. The improvement of claim 1 wherein said enclosure includes means for preventing the impingement of light upon film while in said two containers and further including shelf means, located on the exterior of said enclosure and adjacent to and in said second direction from said first opening and coupled to said structural means, for supporting a piece of film immediately prior to contract with said motive means, said shelf means having a horizontal upper surface occupying a horizontal area occupied by said containers and said drying means, said shelf means having the capacity to support substantially all of a 14 inch by 17 inch piece of film.

3. The improvement of claim 2 wherein substantially all points at which said motive means moves film in a direction having a horizontal component substantially parallel to said first horizontal component of motion occur on said path prior to said path's entry into any of said containers.

4. The improvement of claim 3 wherein said motive means moves film over the top of at least part of said container and said drying means prior to entering any of said containers.

5. The improvement of claim 4 wherein said first direction and said second direction are substantially horizontal.

6. The improvement of claim 1 wherein substantially all points at which said motive means moves film in a direction having a horizontal component substantially parallel to said first horizontal component of motion occur on said path prior to said path's entry into any of said containers.

7. The improvement of claim 6 wherein said motive means moves film over the top of at least part of said container and said drying means prior to entering any of said containers.

8. The improvement of claim 7 wherein said first direction and said second direction are substantially horizontal.

* * * * *